US008866390B2

(12) United States Patent
Choi

(10) Patent No.: US 8,866,390 B2
(45) Date of Patent: Oct. 21, 2014

(54) HYBRID PLASMA REACTOR

(71) Applicant: Dae-Kyu Choi, Gyeonggi-do (KR)

(72) Inventor: Dae-Kyu Choi, Gyeonggi-do (KR)

(73) Assignee: Dae-Kyu Choi, Gyeonggi-do (KR)

( * ) Notice: Subject to any disclaimer, the term of this patent is extended or adjusted under 35 U.S.C. 154(b) by 101 days.

(21) Appl. No.: 13/738,654

(22) Filed: Jan. 10, 2013

(65) Prior Publication Data

US 2013/0175928 A1 Jul. 11, 2013

(30) Foreign Application Priority Data

Jan. 10, 2012 (KR) ..... 10-2012-0002871

(51) Int. Cl.
*H01J 7/34* (2006.01)
*H05B 31/26* (2006.01)
*H05H 1/46* (2006.01)

(52) U.S. Cl.
CPC ..... *H05H 1/46* (2013.01); *H05H 2001/4675* (2013.01); *H05H 2001/4652* (2013.01)
USPC ..... 315/111.41; 315/111.01; 315/111.21; 315/111.51

(58) Field of Classification Search
None
See application file for complete search history.

(56) References Cited

U.S. PATENT DOCUMENTS 7,217,337 B2 * 5/2007 Choi ..... 156/345.38
8,597,464 B2 * 12/2013 Choi ..... 156/345.49
2012/0146508 A1 * 6/2012 Nagarkatti et al. ..... 315/111.21

* cited by examiner

*Primary Examiner* — Anh Tran
(74) *Attorney, Agent, or Firm* — IP & T Group LLP

(57) ABSTRACT

A hybrid plasma reactor includes a first plasma chamber for providing a first ring-shaped plasma discharge space, second plasma chambers providing a second plasma discharge space connected to the first plasma discharge space and coupled to magnetic flux channels, a hybrid plasma source including magnetic cores, which partially surround the first plasma chamber and have magnetic entrances forming the magnetic flux channels, and primary winding coils wound in the magnetic cores and complexly generating ring-shaped transformer-coupled plasma in the first plasma discharge space and magnetic flux channel coupled plasma in the second plasma discharge space, and an AC switching power supply for supplying plasma generation power to the primary winding coils. The hybrid plasma reactor can complexly generate magnetic flux channel coupled plasma and transformer coupled plasma so that it has a high control capability for plasma ion energy and a wide operation region from a low-pressure region to a high-pressure region.

10 Claims, 8 Drawing Sheets

HYBRID PLASMA REACTOR

CROSS-REFERENCE TO RELATED APPLICATION

This application claims priority of Korean patent application numbers 10-2012-0002871 filed on Jan. 10, 2012. The disclosure of each of the foregoing applications is incorporated herein by reference in its entirety.

BACKGROUND

1. Technical Field

The present invention relates to a plasma reactor for generating activated gas containing ions, free-radical, atoms, and molecules by a plasma discharge and performing a plasma processing for a solid, powder, gas, etc. with the activated gas, and more particularly to a hybrid plasma reactor for complexly generating magnetic flux channel coupled plasma and transformer coupled plasma source.

2. Background Art

A plasma discharge has been used for gas excitation for generating activated gas containing ions, free-radical, atoms and molecules. The activated gas is widely used in various fields, and is representatively used in various semiconductor manufacturing processes, such as etching, deposition, cleaning, and ashing.

Recently, a wafer or a Liquid Crystal Display (LCD) glass substrate for manufacturing a semiconductor device becomes larger. In this respect, there is a need of an easily extensible plasma source having a high capability for controlling of plasma ion energy and a capability for processing a large area. It is known that remotely using the plasma is very useful in the process of manufacturing the semiconductor using plasma. For example, the remote use of the plasma has been usefully used in a cleaning of a process chamber or an ashing process for a photoresist strip. However, since a volume of the process chamber increases according to the enlargement of a substrate to be processed, a plasma source capable of remotely and sufficiently supplying high-density activated gas has been demanded.

In the meantime, a remote plasma reactor (or remote plasma generator) uses a transformer coupled plasma source or an inductively coupled plasma source. The remote plasma reactor using the transformer coupled plasma source has a structure in which a magnetic core having a primary winding coil is mounted on a reactor body having a toroidal structure. The remote plasma reactor using the inductively coupled plasma source has a structure in which an inductively coupled antenna is mounted on a reactor body having a hollow tube structure.

Since the remote plasma reactor having the transformer coupled plasma source is operated in a relatively high-pressure atmosphere according to a characteristic thereof, it is difficult to ignite plasma or maintain the ignited plasma in a low-pressure atmosphere. The remote plasma reactor having the inductively coupled plasma source can be operated in a relatively low-pressure atmosphere according to a characteristic thereof, but supplied power should be increased such that remote plasma reactor having the inductively coupled plasma source can be operated in a high-pressure atmosphere, so in this case, the inside of the reactor body may be damaged due to ion bombardment.

Accordingly, a remote plasma reactor efficiently operating at a low pressure or a high pressure is required according to various demands in the semiconductor manufacturing process. However, the conventional remote plasma reactor employing one of the transformer coupled plasma source and the inductively coupled plasma source failed to appropriately respond to the demands.

SUMMARY OF INVENTION

Accordingly, an object of the present invention is to provide a hybrid plasma reactor capable of complexly generating magnetic flux channel coupled plasma and transformer coupled plasma, which has a high control capability for plasma ion energy and a capability of processing of a large area to be easily extendible.

Another object of the present invention to provide a hybrid plasma reactor capable of complexly generating magnetic flux channel coupled plasma and transformer coupled plasma, such that a wide operation region from a low-pressure region to a high-pressure region can be achieved.

Another object of the present invention is to provide a hybrid plasma reactor capable of complexly generating magnetic flux channel coupled plasma and transformer coupled plasma, in which plasma can be easily ignited and the ignited plasma can be maintained in a low-pressure region, and a large amount of plasma can be generated even in a high-pressure region without an internal damage of the reactor.

In order to attain the above object, one aspect according to the preferable embodiments of the present invention provides a hybrid plasma reactor including: a first plasma chamber for providing a first ring-shaped plasma discharge space; second plasma chambers configured to provide a second plasma discharge space connected to the first plasma discharge space and coupled to magnetic flux channels; a hybrid plasma source including magnetic cores, which partially surround the first plasma chamber and have magnetic entrances forming the magnetic flux channels, and primary winding coils wound in the magnetic cores and complexly generating ring-shaped transformer-coupled plasma in the first plasma discharge space and magnetic flux channel coupled plasma in the second plasma discharge space; and an AC switching power supply for supplying plasma generation power to the primary winding coils.

Preferably, the first plasma chamber includes a conductive material or an insulation material.

Preferably, the second plasma chamber includes a dielectric material.

Preferably, the first plasma chamber has at least one electrical insulation region for preventing vortex from being generated.

Preferably, the hybrid plasma source further includes a cooling channel for controlling temperatures of the first plasma chamber and the second plasma chamber.

Preferably, the hybrid plasma source further includes a gas inlet connected to the first plasma chamber or the second plasma chamber and a gas outlet connected to the first plasma chamber or the second plasma chamber.

Preferably, the hybrid plasma source further includes the first plasma chamber includes a conductive material and is electrically grounded.

Preferably, the hybrid plasma source further includes the second plasma chamber is positioned in an internal side of the ring-shaped first plasma chamber.

More preferably, the hybrid plasma source further includes the second plasma chamber is positioned in an external side of the ring-shaped first plasma chamber.

Still More preferably, the hybrid plasma source further includes a vacuum insulation member formed between the first plasma chamber and the second plasma chamber.

The hybrid plasma reactor according to the present invention can complexly generate the magnetic flux channel coupled plasma and the transformer coupled plasma, so that it has a high control capability for the plasma ion energy and a wide operation region from a low pressure region to a high pressure region. Further, the hybrid plasma reactor according to the present invention includes the plurality of magnetic flux channels in the reactor body to generate the magnetic flux channel coupled plasma, so that it has a high control capability for the plasma ion energy, it can generate a large amount of plasma without an internal damage of the reactor in a high pressure region, and it has a structure easily extendible to a large volume.

BRIEF DESCRIPTION OF DRAWINGS

The above and other aspects, features and advantages of the present invention will be more apparent from the following detailed description taken in conjunction with the accompanying drawings, in which.

DESCRIPTION OF EMBODIMENTS

Figure 1:
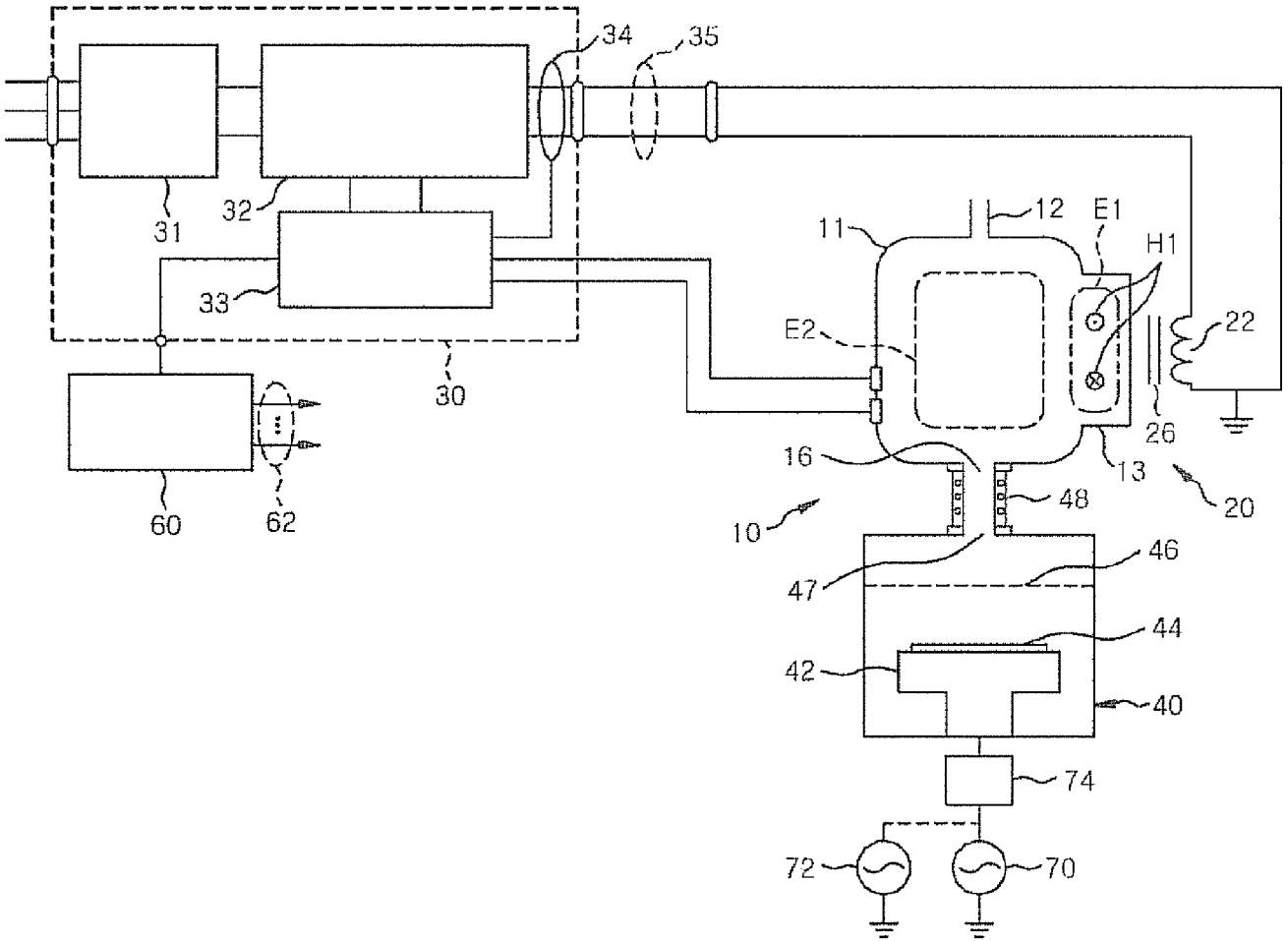
FIG. 1 is a block diagram illustrating a general construction of a hybrid plasma reactor and a plasma processing system including the hybrid plasma reactor according to the present invention.

Hereinafter, an exemplary embodiment of the present invention will be described in detail with reference to the accompanying drawings for the full understanding of the present invention. The embodiment of the present invention will be modified into various forms and it shall not be construed that the scope of the present invention is limited to the embodiment to be described below. The embodiment of the present invention is provided to more fully explain the present invention to a skilled person in the art. Accordingly, a shape, or the like of an element in the drawing may be exaggerated for more accurate description. Like reference numerals indicate like elements throughout the specification and drawings. In the following description, detailed explanation of known related functions and constitutions may be omitted to avoid unnecessarily obscuring the subject manner of the present invention.

FIG. 1 is a block diagram illustrating a general construction of a hybrid plasma reactor and a plasma processing system including the hybrid plasma reactor according to the present invention.

Referring to FIG. 1, a hybrid plasma reactor 10 (hereinafter, simply referred to as a plasma reactor) of the present invention is installed in an outside of a process chamber 40 and remotely supplies plasma to the process chamber 40. The plasma reactor 10 includes a hybrid plasma source 20. The plasma reactor 10 includes a reactor body including a first plasma chamber 11 for providing a first ring-shaped plasma discharge space and second plasma chambers 13 coupled to magnetic flux channels to provide a second plasma discharge space connected to the first plasma discharge space. The reactor body has a gas inlet 12 and a gas outlet 16. The gas outlet 16 is connected to a chamber gas inlet 47 of the process chamber 40 through an adapter 48. The plasma gas generated in the plasma reactor 10 is supplied to the process chamber 40 through the adapter 48. The plasma reactor 10 of the present invention complexly generates magnetic flux channel coupled plasma and transformer coupled plasma, so that it is possible to stably generate the plasma under a wide range of a pressure condition from a low pressure of 1 torr or lower to a high pressure of 10 torr or higher.

The process chamber 40 includes a substrate supporter 42 for supporting a substrate 44 to be processed in the inside thereof. The substrate supporter 42 is electrically connected to one or more bias power supplies 70 and 72 through an impedance matching device 74. The adapter 48 may include an insulation section for electrical insulation and a cooling channel for preventing overheating. The process chamber 40 includes a baffle 46 for distributing plasma gas between the substrate supporter 42 and the chamber gas inlet 47 in the inside thereof. The baffle 46 allows the plasma gas introduced through the chamber gas inlet 47 to be evenly distributed and diffused to the substrate 44 to be processed. For example, the substrate 44 to be processed is a silicon wafer substrate for manufacturing a semiconductor device or a glass substrate for manufacturing an LCD or a plasma display.

The hybrid plasma source 20 is operated through receiving a wireless frequency from a power supply 30. The power supply 30 includes an AC switching power supply 32 including one or more switching semiconductor devices and generating a wireless frequency, a power control circuit 33, and a voltage supply 31. For example, the one or more switching semiconductor devices include one or more switching transistors. The voltage supply 31 converts an alternating voltage input from the outside to a constant voltage and supplies the converted voltage to the AC switching power supply 32. The AC switching power supply 32 is operated according to the control of the power control circuit 33 and generates the wireless frequency.

The power control circuit 33 controls an operation of the AC switching power supply 32 to control the voltage and the current of the wireless frequency. The control of the control circuit 33 is performed based on an electrical or optical parameter value related to at least one of the hybrid plasma source 20 and the hybrid plasma generated in the inside of the first and second plasma chambers 11 and 13. To this end, the power control circuit 33 includes a measurement circuit for measuring the electrical or optical parameter value. For example, the measurement circuit for measuring the electrical and optical parameter of the plasma includes a current probe and an optical detector. The measurement circuit for measuring the electrical parameter of the hybrid plasma source 20 measures a driving current, a driving voltage, an average power, and a maximum power of the hybrid plasma source 20 and a voltage generated in the voltage supply 31.

The power control circuit 33 controls the AC switching power supply 32 while continuously monitoring the related electrical or optical parameter value through the measurement circuit and comparing the measured value and a reference value based on a normal operation, to control the voltage and the current of the wireless frequency. Although it is not specifically illustrated, the power supply 30 includes a protection circuit for preventing an electrical damage which may be generated due to an abnormal operation environment. The power supply 30 is connected to a system controller 60 for generally controlling the plasma processing system. The power supply 30 provides the system controller 60 with operation state information on the plasma reactor 10. The system controller 60 generates a control signal for generally controlling the operation of the plasma processing system and controls the operation of the plasma reactor 10 and the process chamber 40.

The plasma reactor 10 and the power supply 30 have a physically separated structure. That is, the plasma reactor 10 is electrically connected to the power supply 30 by a wireless frequency supply cable 35. The separation structure of the plasma reactor 10 and the power supply 30 secures easy repair and maintenance and easy installation. However, the plasma reactor 10 may be integrally formed with the power supply 30.

Figure 2:
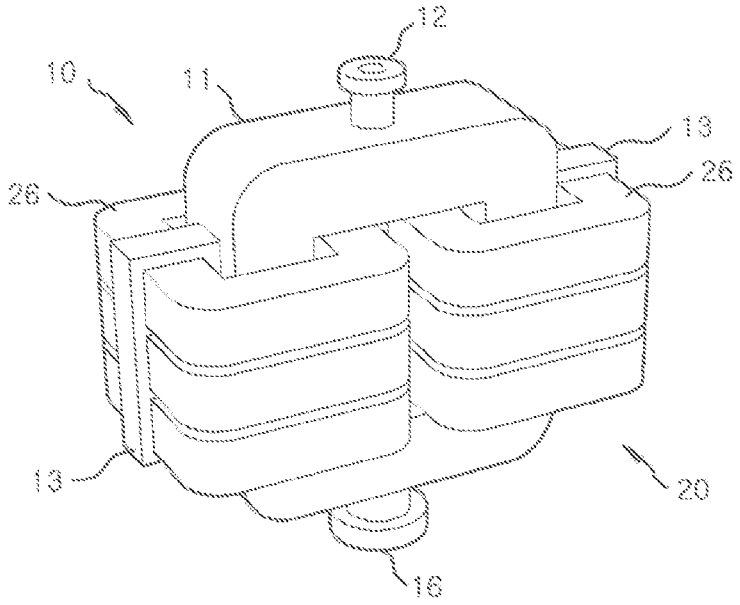
FIG. 2 is a perspective view illustrating an external appearance of a hybrid plasma reactor according to an embodiment of the present invention.
Figure 3:
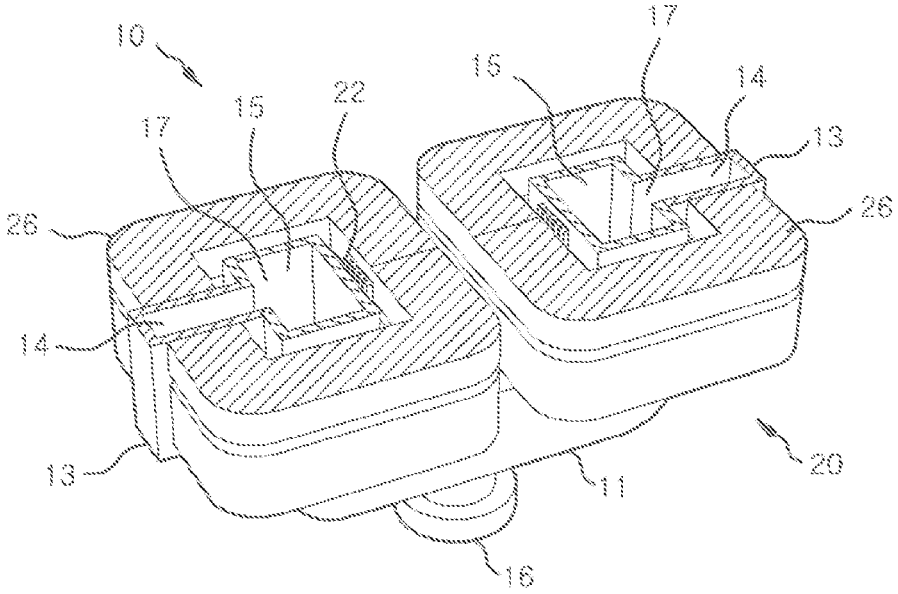
FIG. 3 is a partial cross-sectional perspective view illustrating an internal structure of the hybrid plasma reactor of FIG. 2.
Figure 4:
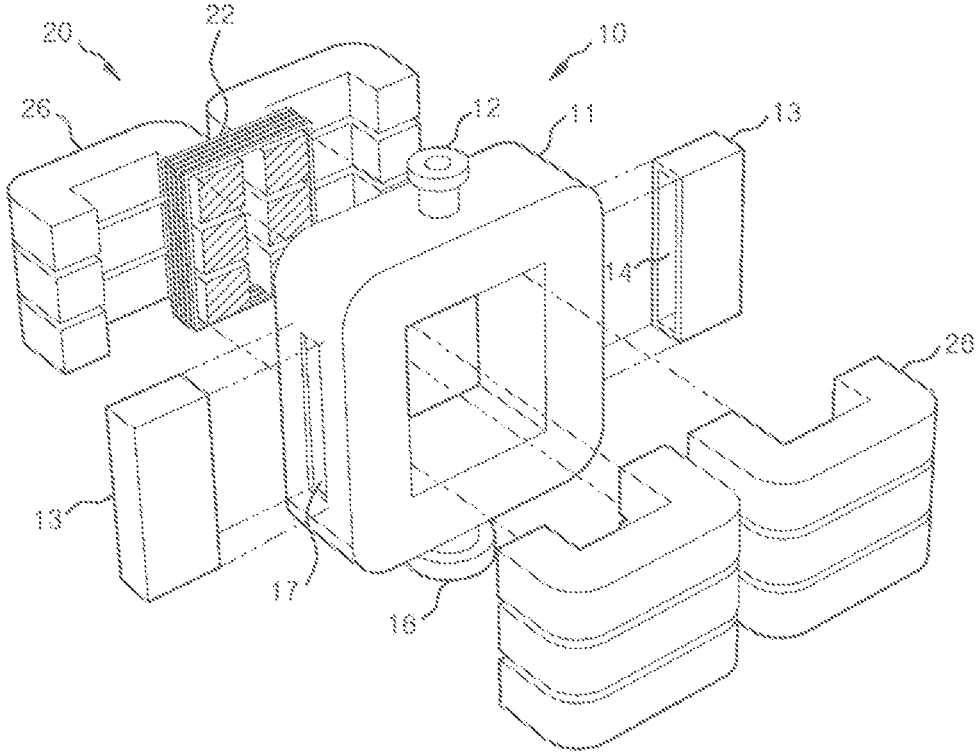
FIG. 4 is an exploded perspective view illustrating the hybrid plasma reactor of FIG. 2.
Figure 5:
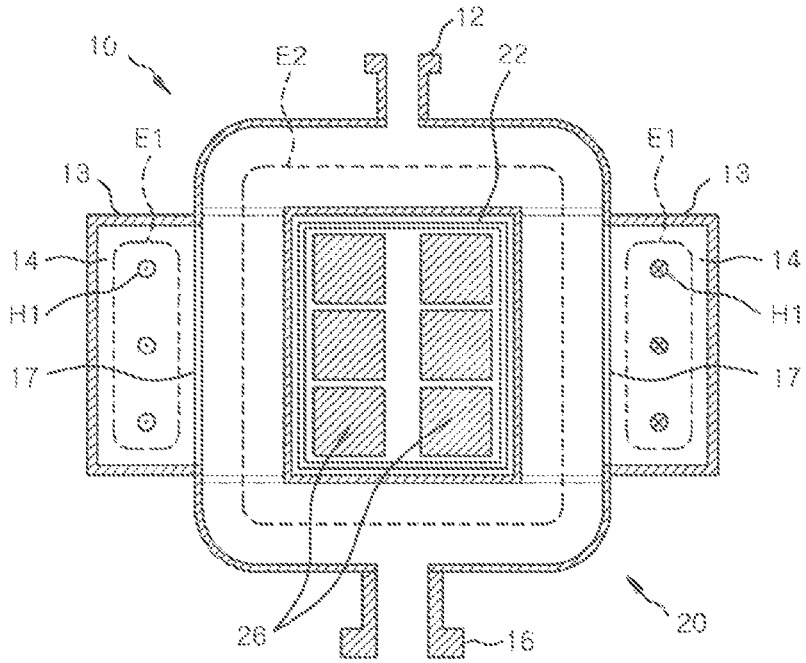
FIG. 5 is a vertical sectional view illustrating the hybrid plasma reactor of FIG. 2.
Figure 6:
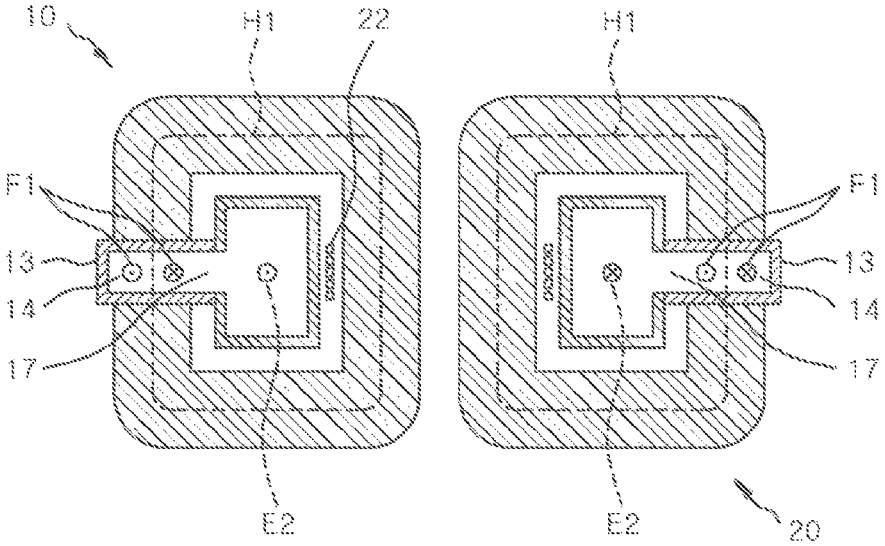
FIG. 6 is a horizontal sectional view illustrating the hybrid plasma reactor of FIG. 2.

FIG. 2 is a perspective view illustrating an external appearance of a hybrid plasma reactor according to an embodiment of the present invention, and FIG. 3 is a partial cross-sectional perspective view illustrating an internal structure of the hybrid plasma reactor of FIG. 2. FIGS. 4 to 6 are an exploded perspective view, a vertical sectional view, and a horizontal sectional view illustrating the hybrid plasma reactor of FIG. 2, respectively.

Referring to FIGS. 2 to 6, the hybrid plasma reactor 10 according to an exemplary embodiment of the present invention includes the reactor body including the first plasma chamber 11 for providing a first ring-shaped plasma discharge space 15 and the second plasma chambers 13 coupled to magnetic flux channels to providing the second plasma discharge spaces 14 connected to the first plasma discharge space 15. The two second plasma chambers 13 are disposed in opposite sides of the outside of the first ring-shaped plasma chamber 11. The gas inlet 12 and the gas outlet 16 are formed in an upper part and a lower part of the first plasma chamber 11, respectively. The gas inlet 12 and the gas outlet 16 may be formed in the second plasma chambers 13. Although it is not illustrated in the drawings, the first plasma chamber 11 and the second plasma chambers 13 are connected and sealed by means of a vacuum insulation member.

The hybrid plasma source 20 includes magnetic cores 26 including a magnetic flux entrance forming magnetic flux channels and primary winding coils 22 wound in the magnetic cores 26. The magnetic cores 26 are divided into two groups and positioned such that the second plasma chambers 13 are coupled between the magnetic flux entrances while the first plasma chamber 11 is partially surrounded. Accordingly, the magnetic flux channel coupled plasma is generated in the second plasma discharge space by an electric field E1 induced by a magnetic field H1 of the magnetic flux channel coupled to the second plasma chamber 13. Along with this, the ring-shaped transformer coupled plasma is complexly generated by an electric field E2 generated in the first plasma discharge space of the first plasma chamber 11.

Figure 7:
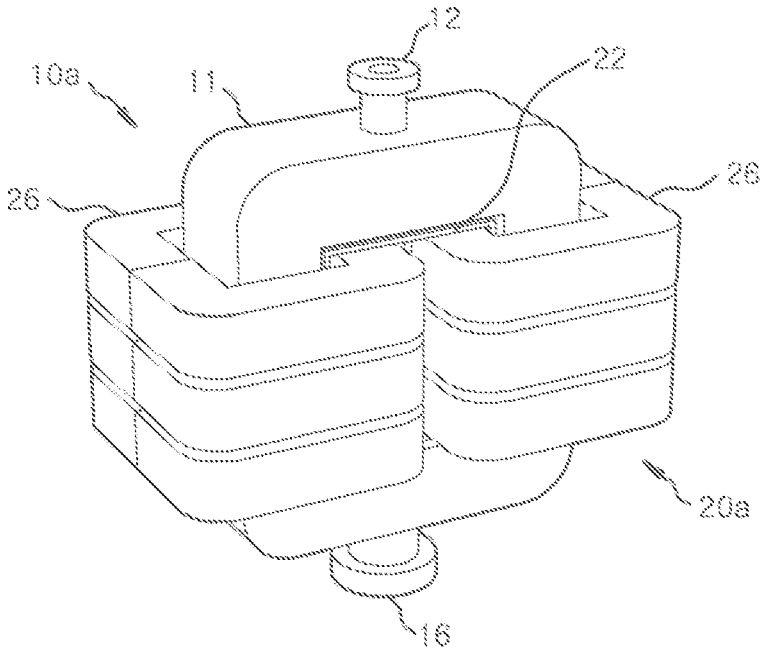
FIG. 7 is a perspective view illustrating an external appearance of a hybrid plasma reactor according to another embodiment of the present invention.
Figure 8:
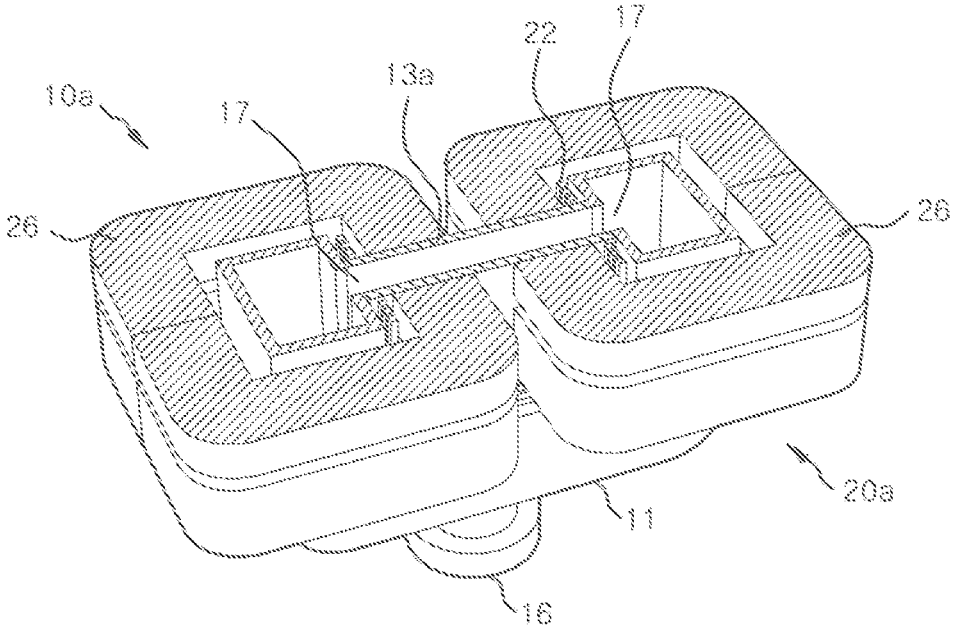
FIG. 8 is a partial cross-sectional perspective view illustrating an internal structure of the hybrid plasma reactor of FIG. 7.
Figure 9:
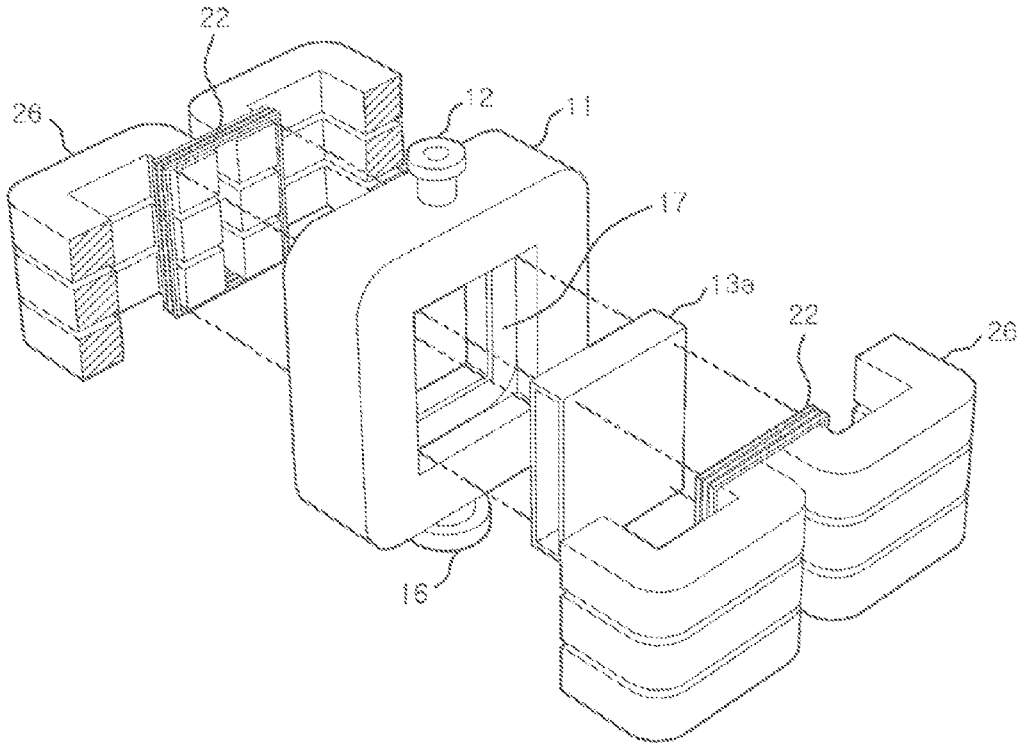
FIG. 9 is an exploded perspective view illustrating the hybrid plasma reactor of FIG. 7.
Figure 10:
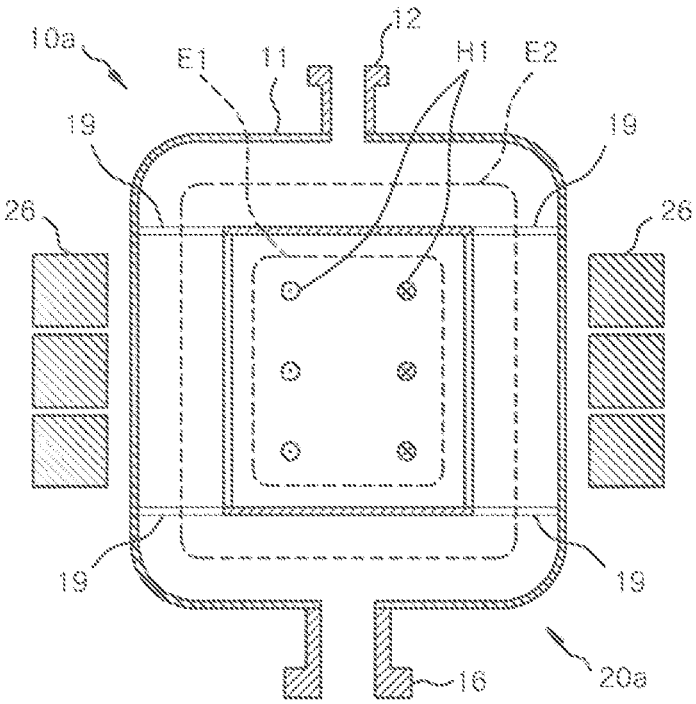
FIG. 10 is a vertical sectional view illustrating the hybrid plasma reactor of FIG. 7.
Figure 11:
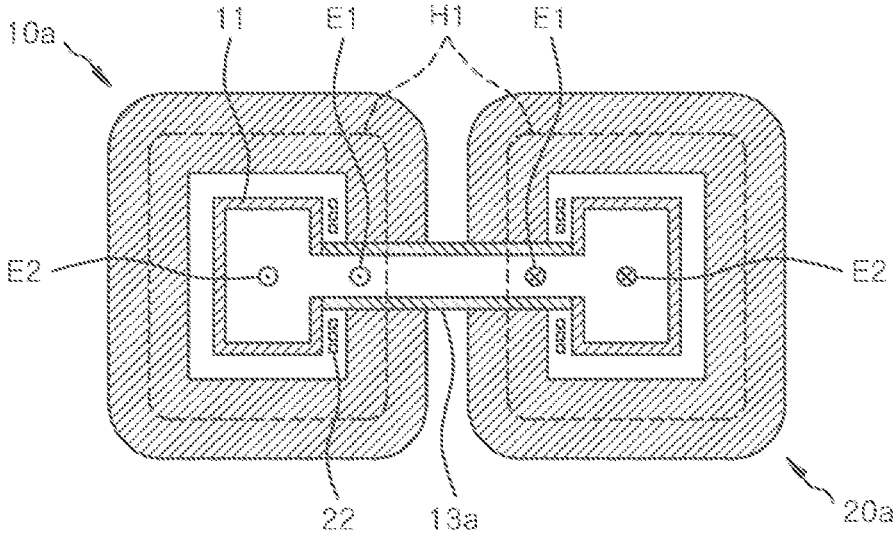
FIG. 11 is a horizontal sectional view illustrating the hybrid plasma reactor of FIG. 7.

FIG. 7 is a perspective view illustrating an external appearance of a hybrid plasma reactor according to another embodiment of the present invention, FIG. 8 is a partial cross-sectional perspective view illustrating an internal structure of the hybrid plasma reactor of FIG. 7. FIGS. 9 to 11 are exploded perspective view, a vertical sectional view, and a horizontal sectional view illustrating the hybrid plasma reactor of FIG. 7.

Referring to FIGS. 7 to 11, a hybrid plasma reactor 10*a* according to another exemplary embodiment of the present invention includes a reactor body including a first plasma chamber 11 for providing a first ring-shaped plasma discharge space 15 and a second plasma chamber 13*a* coupled to magnetic flux channels to providing a second plasma discharge space 14 connected to the first plasma discharge space 15. The second plasma chamber 13*a* is disposed in an inside of the first ring-shaped plasma chamber 11. The gas inlet 12 and the gas outlet 16 are formed in an upper part and a lower part of the first plasma chamber 11, respectively. The gas inlet 12 and the gas outlet 16 may be formed in the second plasma chamber 13*a*. Although it is not illustrated in the drawings, the first plasma chamber 11 and the second plasma chamber 13*a* are connected and sealed by means of a vacuum insulation member.

A hybrid plasma source 20 includes magnetic cores 26 including a magnetic flux entrance forming magnetic flux channels and primary winding coils 22 wound in the magnetic cores 26. The magnetic cores 26 are divided into two groups and positioned such that the second plasma chamber 13*a* is coupled between the magnetic flux entrances while the first plasma chamber 11 is partially surrounded. Accordingly, the magnetic flux channel coupled plasma is generated in the second plasma discharge space by an electric field E1 induced by a magnetic field H1 of the magnetic flux channel coupled to the second plasma chamber 13*a*. Along with this, the ring-shaped transformer coupled plasma is complexly generated by an electric field E2 generated in the first plasma discharge space of the first plasma chamber 11.

Figure 12:
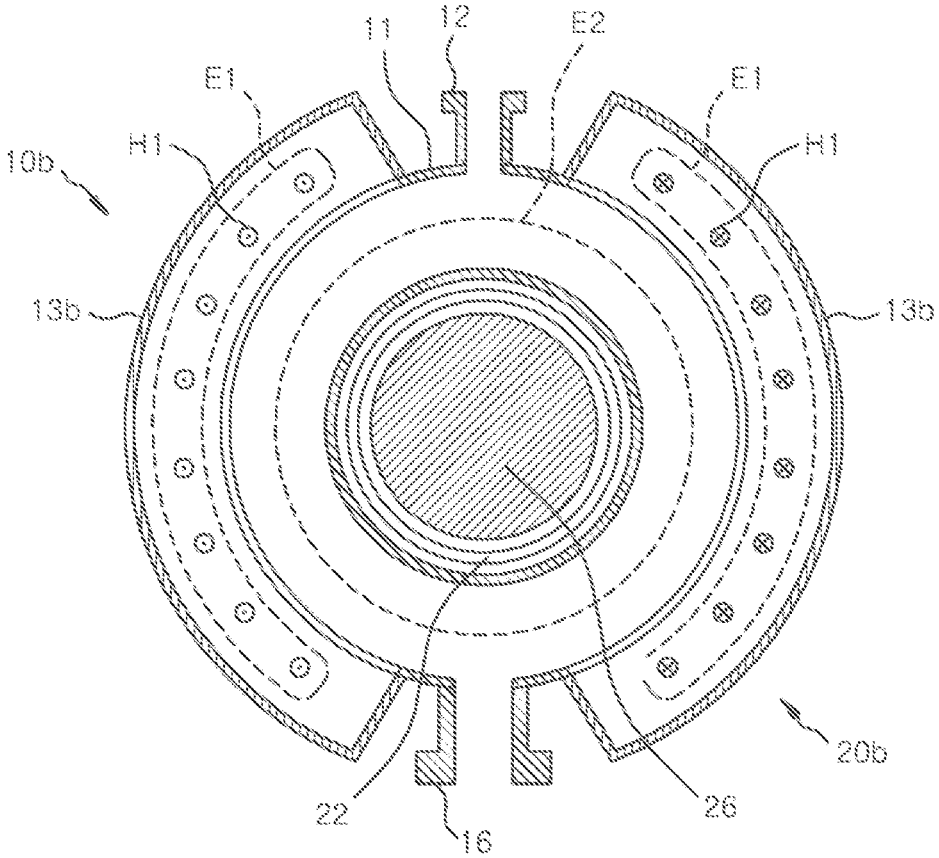
FIG. 12 is a vertical sectional view illustrating a hybrid plasma reactor according to another embodiment of the present invention.

FIG. 12 is a vertical sectional view illustrating a hybrid plasma reactor according to another embodiment of the present invention.

Referring to FIG. 12, a hybrid plasma reactor 10*b* according to another embodiment of the present invention has the same construction as those of the aforementioned embodiments. However, the hybrid plasma reactor 10*b* according to another embodiment of the present invention includes a first plasma chamber 11 having a round structure, differently from the first ring-shaped plasma chamber 11, and second plasma chambers 13*b* having a smooth circular arc and mounted in both sides of the first plasma chamber 11. Further, a structure of the magnetic core 26 is changed so as to be appropriate for the structures of the first and second plasma chambers 11 and 13*b*.

As described above, the hybrid plasma reactor 10, 10*a*, and 10*b* according to the present invention generates the transformer coupled plasma in the first plasma chamber 11 by the hybrid plasma source 20, 20*a*, and 20*b* formed of the magnetic core 26 having the primary winding coils 22 and complexly generate the magnetic flux channel coupled plasma in the second plasma chamber 13.

Accordingly, the hybrid plasma reactor 10, 10*a*, and 10*b* according to the present invention can complexly generate the magnetic flux channel coupled plasma and the transformer coupled plasma, so that it has a high control capability for the plasma ion energy and a wide operation region from a low pressure region to a high pressure region. Further, the hybrid plasma reactor 10, 10*a*, and 10*b* according to the present invention forms the multiple magnetic flux channels in the inside of the reactor body to generate the magnetic flux channel coupled plasma, so that it has a high control capability for the plasma ion energy, it can generate a large amount of plasma without an internal damage of the reactor in a high pressure region, and it has a structure easily extendible to a large volume.

The first plasma chamber 11 may be made of a conductive material or an insulation material. However, if the first plasma chamber 11 is made of the conductive material, the vortex may be generated in the first plasma chamber 11 by the hybrid plasma source 20, 20*a*, and 20*b*, so that it is preferable to construct an electrical insulation region 19 for preventing the generation of the vortex. If the first plasma chamber 11 is made of the conductive material, the first plasma chamber 11 is preferably electrically grounded. The second plasma chamber 13 and 13*a* is coupled to the magnetic flux channels so that it is preferably made of a dielectric material.

Although it is not specifically illustrated, the hybrid plasma reactor 10, 10*a*, and 10*b* include a cooling channel for controlling a temperature. The cooling channel is installed at an appropriate position of the hybrid plasma reactor 10, 10*a*, and 10*b* for prevention of overheating. For example, the cooling channel may be installed in the first plasma chamber 11 or the second plasma chamber 13. Otherwise, a component for forming a separate cooling channel may be additionally installed.

The foregoing is merely an exemplary embodiment of the hybrid plasma reactor according to the present invention, and it will be readily understood by those skilled in the art that various modifications and changes can be made thereto within the technical spirit and scope of the present invention, and the scope of the present invention shall not be limited to the described embodiment. Accordingly, the technical protective scope of the present invention shall be defined by the technical spirits of the accompanied claims. Further, those skilled in the art will appreciate that the present invention includes all modifications, equivalents, and substitutes within the scope of the spirit of the present invention defined by the accompanied claims.

What is claimed is:

1. A hybrid plasma reactor comprising:

a first plasma chamber for providing a first ring-shaped plasma discharge space;

second plasma chambers configured to provide a second plasma discharge space connected to the first plasma discharge space and coupled to magnetic flux channels;

a hybrid plasma source including magnetic cores, which partially surround the first plasma chamber and have magnetic entrances forming the magnetic flux channels, and primary winding coils wound in the magnetic cores and complexly generating ring-shaped transformer-coupled plasma in the first plasma discharge space and magnetic flux channel coupled plasma in the second plasma discharge space; and an AC switching power supply for supplying plasma generation power to the primary winding coils.

2. The hybrid plasma source as claimed in claim 1, wherein the first plasma chamber includes a conductive material or an insulation material.

3. The hybrid plasma source as claimed in claim 1, wherein the second plasma chamber includes a dielectric material.

4. The hybrid plasma source as claimed in claim 1, wherein the first plasma chamber has at least one electrical insulation region for preventing vortex from being generated.

5. The hybrid plasma source as claimed in claim 1, further comprising a cooling channel for controlling temperatures of the first plasma chamber and the second plasma chamber.

6. The hybrid plasma source as claimed in claim 1, further comprising a gas inlet connected to the first plasma chamber or the second plasma chamber and a gas outlet connected to the first plasma chamber or the second plasma chamber.

7. The hybrid plasma source as claimed in claim 1, wherein the first plasma chamber includes a conductive material and is electrically grounded.

8. The hybrid plasma source as claimed in claim 1, wherein the second plasma chamber is positioned in an internal side of the ring-shaped first plasma chamber.

9. The hybrid plasma source as claimed in claim 1, wherein the second plasma chamber is positioned in an external side of the ring-shaped first plasma chamber.

10. The hybrid plasma source as claimed in claim 1, further comprising a vacuum insulation member formed between the first plasma chamber and the second plasma chamber.

* * * * *